US008077131B2

(12) United States Patent
Kang et al.

(10) Patent No.: US 8,077,131 B2
(45) Date of Patent: Dec. 13, 2011

(54) LIQUID CRYSTAL DISPLAY AND METHOD OF DRIVING THE SAME FOR IMPROVING LUMINANCE UNIFORMITY

(75) Inventors: Chih-Tsung Kang, Tainan County (TW); Chi-Ting Huang, Tainan County (TW)

(73) Assignee: Chimei Innolux Corporation, Miao-Li County (TW)

( * ) Notice: Subject to any disclaimer, the term of this patent is extended or adjusted under 35 U.S.C. 154(b) by 723 days.

(21) Appl. No.: 12/174,680

(22) Filed: Jul. 17, 2008

(65) Prior Publication Data

US 2009/0021465 A1 Jan. 22, 2009

(30) Foreign Application Priority Data

Jul. 20, 2007 (TW) ..... 96126697 A

(51) Int. Cl.
*G09G 3/36* (2006.01)

(52) U.S. Cl. ..... 345/98

(58) Field of Classification Search ..... 345/89, 345/98, 103, 214
See application file for complete search history.

(56) References Cited

U.S. PATENT DOCUMENTS

| | | | | |
|---|---|---|---|---|
| 6,937,233 | B2 * | 8/2005 | Sakuma et al. | 345/98 |
| 7,342,561 | B2 * | 3/2008 | Hiraki et al. | 345/87 |
| 7,466,310 | B2 * | 12/2008 | Yang et al. | 345/87 |
| 2003/0132906 | A1 * | 7/2003 | Tanaka et al. | 345/89 |
| 2008/0062155 | A1 * | 3/2008 | Wang et al. | 345/87 |
| 2008/0068404 | A1 * | 3/2008 | Ishii | 345/690 |

* cited by examiner

*Primary Examiner* — Chanh Nguyen
*Assistant Examiner* — Allison Walthall
(74) *Attorney, Agent, or Firm* — Lowe Hauptman Ham & Berner LLP

(57) ABSTRACT

In a liquid crystal display or panel and a method of driving the same, in response to the receipt of a plurality of image control signals each intended for one of the data lines, the image control signals are modified in accordance with different characteristics of the data lines. The modified image control signals are outputted to the respective data lines to drive the liquid crystal display or panel.

18 Claims, 4 Drawing Sheets

LIQUID CRYSTAL DISPLAY AND METHOD OF DRIVING THE SAME FOR IMPROVING LUMINANCE UNIFORMITY

This application claims the benefit of Taiwan application Serial No. 96126697, filed Jul. 20, 2007, the entire subject matter of which is incorporated herein by reference.

BACKGROUND

1. Technical Field

The disclosure relates to an image control signal compensation technique for liquid crystal displays and, more particularly, to a liquid crystal display capable of improving luminance uniformity and a method of driving the same.

2. Related Art

At a certain enlarged panel size and due to the influences of temperature at high and low voltage ends and the variations of backlight luminance, human eyes may notice the phenomenon that the sides of a liquid crystal display panel are brighter while the center is dimmer at low gray scales. That is, the luminance uniformity of conventional liquid crystal display panel is not satisfactory at low gray scales. With the increase of panel size and resolution (as well as associated non-uniform variations of cell gap) and the raise of frame rate (120 Hz), the amount of data to be processed increases. Therefore, the time for data to be processed is shortened, and the resistive-capacitive loading (RC loading) in a conventional liquid crystal display panel more seriously distorts signals, resulting in a more apparent phenomenon of non-uniform luminance of the panel.

To lessen the problem of non-uniform luminance, the shape of scan waveforms can be changed. For instance, the height of scan waveforms can be lowered by reducing the gate high-voltage (VGH) to cause insufficient charging of scan drive input terminals at the sides of a panel so as to lower the luminance at the sides of the panel. However, the luminance degrees at the center and the sides of the panel are inevitably different. Moreover, this method would indirectly affect the charging of the center region. In general, the higher the gate high-voltage, the greater the drain current of the thin-film transistor (TFT), and the faster the charging speed. Therefore, the phenomenon of insufficient charging or reduced transmittance would be less likely to occur. If the gate high-voltage is lowered, the charging of the center region would be insufficient. To avoid substantially affecting the total transmittance of the whole panel, there is a certain limit to the reduction of gate high-voltage, and hence, it is difficult to satisfactorily improve the luminance uniformity.

Besides, white-tracking and over-driving can also be adjusted. Conventionally, because the luminance of a whole panel is adjusted with only a single white-tracking code and a single over-driving value, it is difficult to effectively improve the luminance uniformity of the whole panel.

SUMMARY

In an embodiment, a method of driving a liquid crystal panel in response to a plurality of image control signals being transmitted to a plurality of pixels in said liquid crystal panel via a plurality of source driver units and a plurality of data lines respectively connected with the source driver units is disclosed. The method comprises the steps of: providing a white-tracking code; applying a plurality of different first weights to said white-tracking code to obtain a plurality of weighted white-tracking codes, each of said first weights being associated with one of the data lines; providing an over-driving value; applying a plurality of different second weights to said over-driving value to obtain a plurality of weighted over-driving values, each of said second weights being associated with one of the data lines; and for each of said data lines, selecting and outputting one of said weighted white-tracking codes and one of said weighted over-driving values to the corresponding source driver unit to adjust said image control signals inputted to the pixels associated with said data line.

In another embodiment, a liquid crystal display is disclosed to comprise: a liquid crystal panel having a plurality of data lines and a plurality of corresponding pixels; a plurality of source driver units coupled to said data lines, respectively; and an image processor coupled to said source driver units for receiving a plurality of image control signals, modifying the image control signals in accordance with different characteristics of said data lines, and outputting said modified image control signals to said source driver units, respectively.

In a further embodiment, a method of driving a liquid crystal display is disclosed. The liquid crystal display comprises a plurality of source driver units and a plurality of data lines connected therewith. The method comprises the steps of: receiving a plurality of image control signals each intended for one of the data lines; modifying said image control signals to obtain a plurality of modified image control signals in accordance with different characteristics of said data lines; and outputting said modified image control signals to the respective data lines to drive said liquid crystal display.

BRIEF DESCRIPTION OF THE DRAWINGS

The various objects and advantages of embodiments of the present invention will be more readily understood from the following detailed description when read in conjunction with the appended drawings, in which.

DETAILED DESCRIPTION OF EMBODIMENTS

The following description discloses a liquid crystal display and a method of driving the same, wherein the image control signal supplied to each pixel of the liquid crystal panel can be adjusted to enhance the luminance uniformity of the liquid crystal panel.

Figure 1:
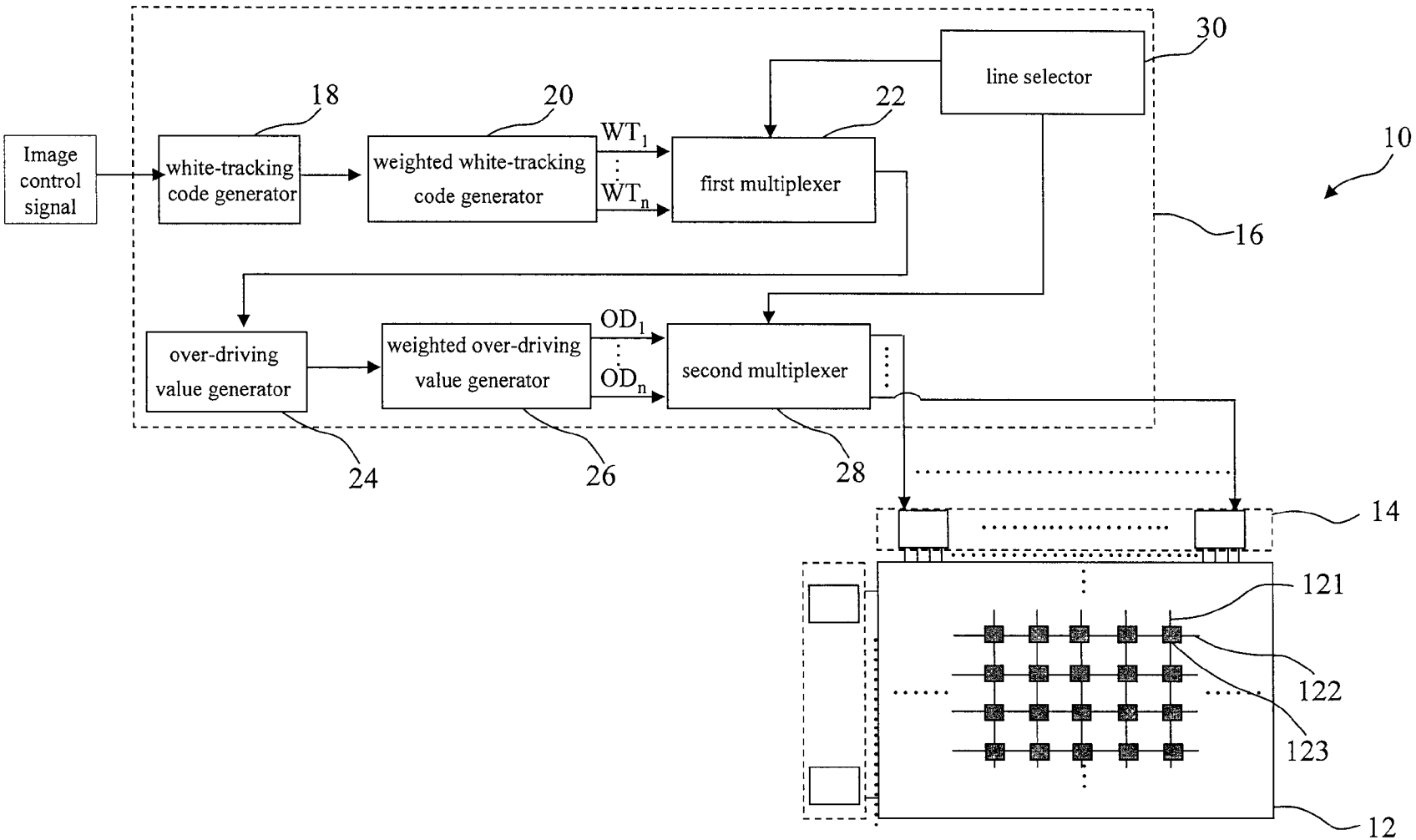
FIG. 1 is an architecture diagram of a liquid crystal display according to a first embodiment of the present invention.

FIG. 1 is an architecture diagram of a liquid crystal display according to a first embodiment of the present invention. As shown in FIG. 1, a liquid crystal display 10 comprises a liquid crystal panel 12, a plurality of source driver units 14, and an image processor 16. The liquid crystal panel 12 has data lines 121 and scan lines 122 that are mutually perpendicular, and pixels 123 located at and/or near intersections of the data lines 121 and the scan lines 122. The source driver units 14 are coupled to the data lines 121, and the image processor 16. Each source driver unit 14 is coupled to drive one or more of the data lines 121.

The image processor 16 includes a white-tracking code generator 18, a weighted white-tracking code generator 20 coupled to the white-tracking code generator 18, a first multiplexer 22 coupled to the weighted white-tracking code generator 20, an over-driving value generator 24 coupled to the first multiplexer 22, a weighted over-driving value generator 26 coupled to the over-driving value generator 24, a second multiplexer 28 coupled to the weighted over-driving value generator 26 and the source driver units 14, and a line selector 30 coupled to the first multiplexer 22 and the second multiplexer 28.

Figure 2:
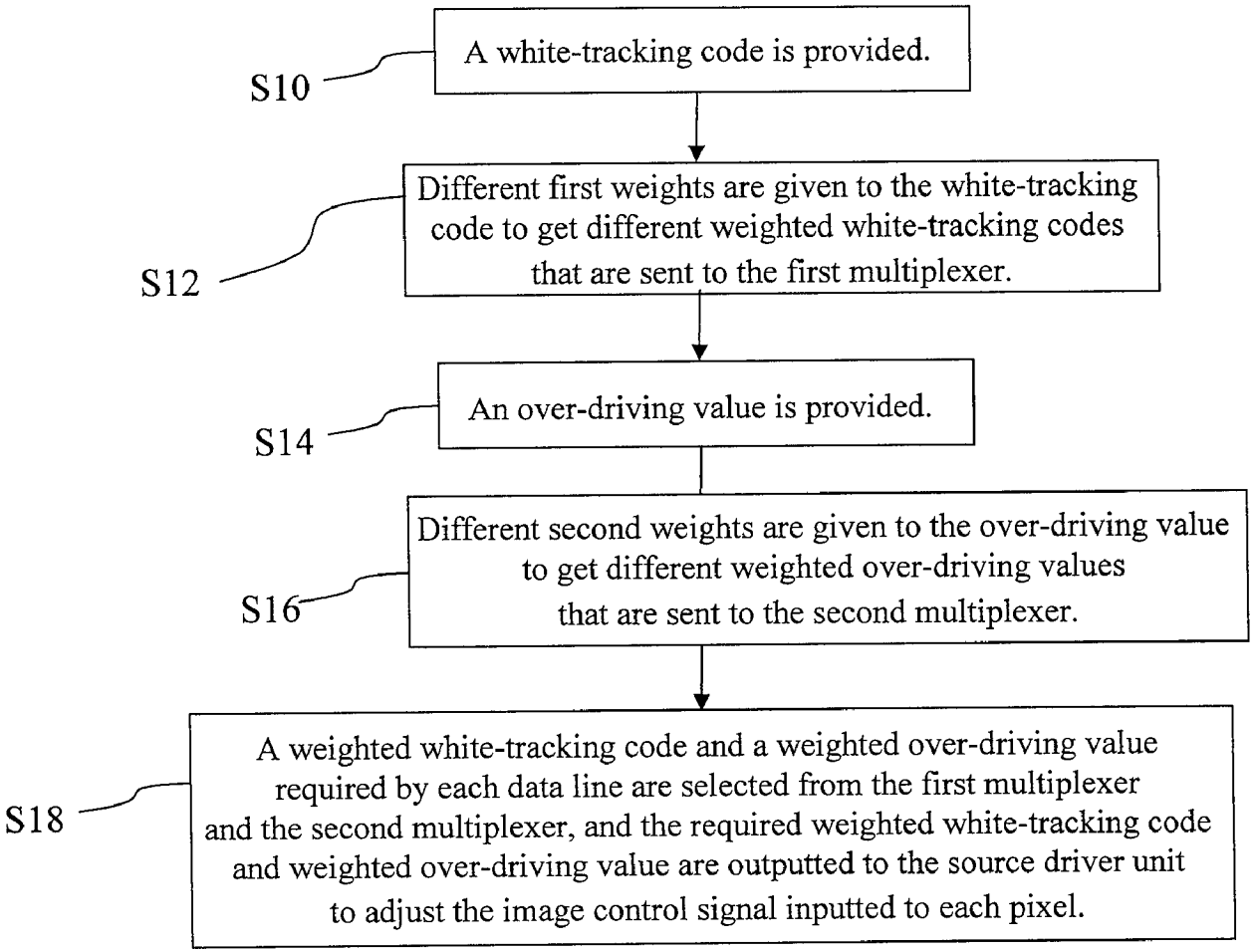
FIG. 2 is a flowchart of a driving method according to the first embodiment of the present invention.

FIG. 2 is a flowchart of a driving method according to the first embodiment of the present invention. Reference will now be made to FIG. 2 as well as FIG. 1. First, the white-tracking code generator 18 provides a white-tracking code (Step S10) based on image control signals intended for the pixels 123. Next, the weighted white-tracking code generator 20 (e.g., a first multiplier) is used to give different first weights to the white-tracking code to obtain different weighted white-tracking codes WT1~WTn that are sent to the first multiplexer 22 (Step S12). Each of the first weights corresponds to a region of the display panel, and more particularly, to a source driver unit 14 that controls the data line(s) 121 in that region. For example, the display panel can be divided into a number of vertical stripe-shaped regions each of which corresponds to one of the source driver units 14 and is assigned a respective first weight. The first weights vary from one region to another, so that the same white-tracking code applied to adjacent regions will generally cause the pixels in the adjacent regions to display different grey values, thereby improving luminance uniformity of the whole panel. The first weights, in an embodiment, are determined empirically for a representative LCD panel in a batch, and then applied to the other LCD panels in that batch.

The line selector 30 generates a line selection signal corresponding to the pixel(s) 123 for which the image control signals are intended. Based on the line selection signal received from the line selector 30, the first multiplexer 22 outputs one of the weighted white-tracking codes WT1~WTn to the over-driving value generator 24.

The over-driving value generator 24, which in an embodiment is a look-up table, receives the weighted white-tracking code outputted by the first multiplexer 22 and provides a corresponding over-driving value (Step S14). Subsequently, the weighted over-driving value generator 26 (e.g., a second multiplier) is used to give different second weights to the over-driving value outputted by the over-driving value generator 24 to obtain different weighted over-driving values OD1~ODn that are sent to the second multiplexer 28 (Step S16). The second weights in an embodiment are determined empirically and assigned in a manner similar to the first weights.

The line selection signal of the line selector 30 is again used to select a weighted over-driving value corresponding to the data line(s) 121 containing the pixel(s) 123 for which the image control signals are intended. Thus, the second multiplexer 28 selectively outputs the weighted white-tracking code and weighted over-driving value to the corresponding source driver unit 14 so as to adjust the image control signal inputted to each pixel 123 (Step S18). The adjusted image control signal finally will use the source driver unit 14 and the data line 121 to drive the corresponding pixel 123.

Because the luminance of the pixels 123 at and/or near the center of the liquid crystal panel 12 is lower than that at the sides, e.g., lateral sides, of the liquid crystal panel 12, if the luminance of the pixel 123 corresponding to the data line 121 at the center of the liquid crystal panel 12 is used as the standard (its first weight is set to, e.g., 1), other data lines 121 need to choose weighted white-tracking codes with first weights between 0 and 1. In an embodiment, the first weights are higher for display panel regions that are closer to the center of the display panel, and are lower for display panel regions that are closer to either side of the display panel. Similarly, the response speed of a pixel 123 corresponding to a certain data line 121 can be used as the standard (its second weight is set to, e.g., 1), other data lines need to choose weighted over-driving values with second weights between 0 and 1.

In an embodiment where each source driver unit 14 is coupled to control multiple data lines 121 through electrical resistances, the resistances of the same source driver units 14 can be the same or different according to practical requirements. If one doesn't want the first weights or the second weights to differ much from 1, the source driver units 14 with different resistances can be adopted. In this case, the first weight and the second weight required by each pixel 123 will differ from those used when source driver units 14 with the same resistance are used. When the source driver units 14 with different resistances are used, the data lines 121 coupled to the same source driver unit 14 are controlled differently due to the different resistances via which the data lines 121 are coupled to the source driver unit 14. It can be considered that the first weights and the second weights provide coarse control of luminance uniformity whereas the different resistances of each source driver unit 14 provide fine control of luminance uniformity. In a further embodiment when fine control of luminance uniformity is not required, each source driver unit 14 is coupled to the respective data lines 121 via the same resistances.

Figure 3:
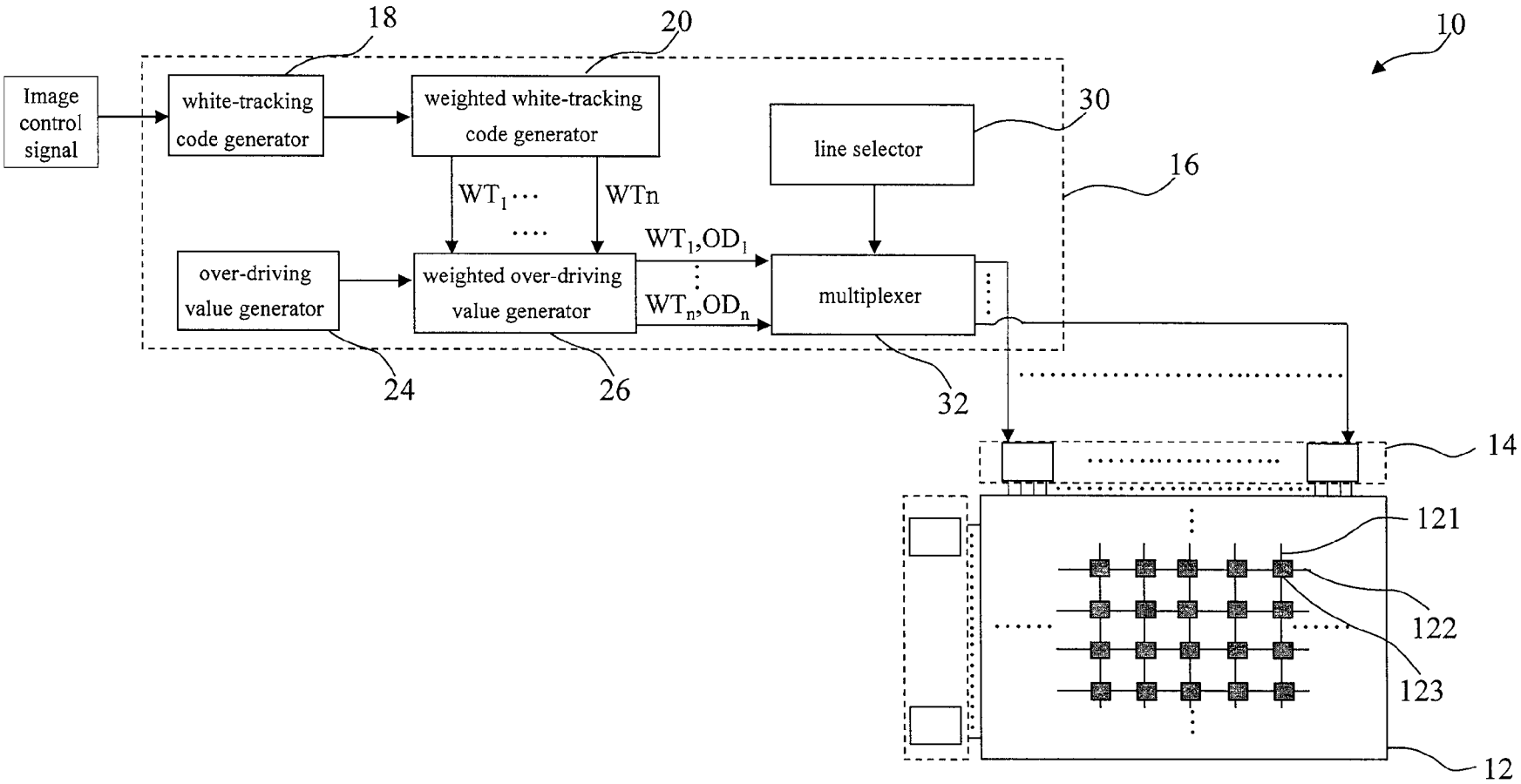
FIG. 3 is an architecture diagram of a liquid crystal display according to a second embodiment of the present invention.

FIG. 3 is an architecture diagram of a liquid crystal display according to a second embodiment of the present invention. As shown in FIG. 3, the image processor 16 includes the white-tracking code generator 18, the weighted white-tracking code generator 20 (e.g., a first multiplier) coupled to the white-tracking code generator 18, the over-driving value generator 24, the weighted over-driving value generator 26 (e.g., a second multiplier) coupled to the weighted white-tracking code generator 20 and the over-driving value generator 24, a multiplexer 32 coupled to the weighted over-driving value generator 26 and the source driver units 14, and the line selector 30 coupled to the multiplexer 32.

Figure 4:
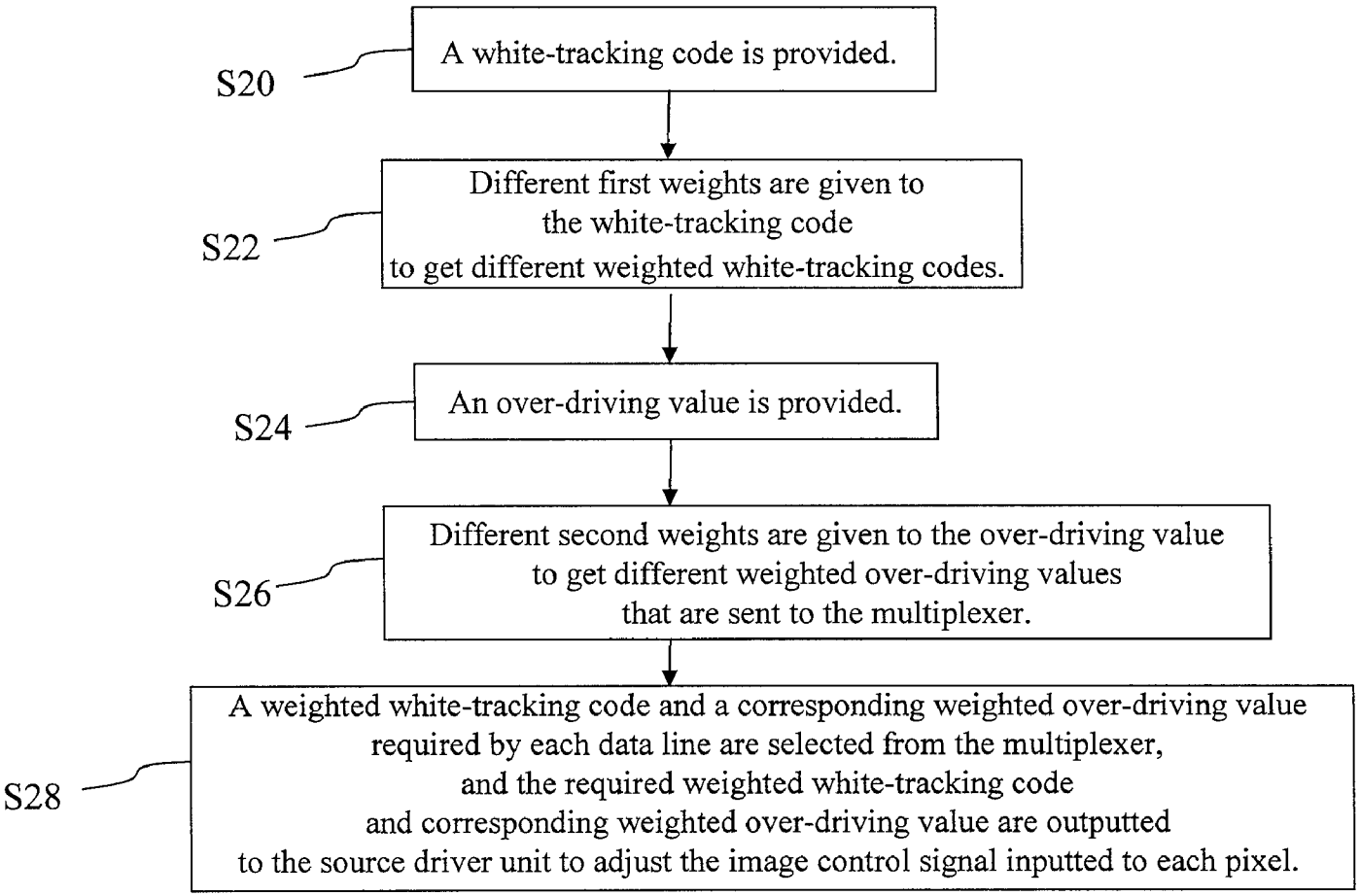
FIG. 4 is a flowchart of a driving method according to the second embodiment of the present invention.

FIG. 4 is a flowchart of a driving method according to the second embodiment of the present invention. Reference will be now made to FIG. 4 as well as FIG. 3. First, the white-tracking code generator 18 provides a white-tracking code (Step S20) based on image control signals intended for the pixels 123. Next, the weighted white-tracking code generator 20 is used to give different first weights to the white-tracking code to obtain different weighted white-tracking codes WT1~WTn (Step S22) in a manner similar to the embodiments disclosed above with respect to FIG. 1. The weighted over-driving value generator 26 then consults the over-driving value generator 24, e.g. a look up table, to obtain, for each of the weighted white-tracking codes WT1~WTn, a corresponding over-driving value (Step S24). The weighted over-driving value generator 26 subsequently gives different second weights to the over-driving values to obtain different weighted over-driving values OD1~ODn that are sent to the multiplexer 32 (Step S26). The line selector 30 generates a line selection signal corresponding to the pixel(s) 123 for which the image control signals are intended. Based on the line selection signal received from the line selector 30, the multiplexer 32 selectively outputs the required weighted white-tracking code and corresponding weighted over-driving value required by each data line 121 to the corresponding source driver unit 14 so as to adjust the image control signal inputted to each pixel 123 (Step S28). The adjusted image control signal finally will use the source driver unit 14 and the data line 121 to drive the corresponding pixel 123. The first weights and the second weights are between 0 and 1. The resistances of the source driver units 14 can be the same or different according to practical requirements. The reason is the same as that discussed above with respect to the embodiments of FIG. 1.

Although in the foregoing description the white-tracking code generator 18, the weighted white-tracking code generator 20, the multiplexers 22, 28, 32, the over-driving value generator 24 and the weighted over-driving value generator 26 are disclosed as outputting codes, the present invention is not limited to such arrangement. Specifically, each of the white-tracking code generator 18, the weighted white-tracking code generator 20, the multiplexers 22, 28, 32, the over-driving value generator 24 and the weighted over-driving value generator 26, in at least some embodiments, are configured to output modified image control signals based on the respective codes. For example, the white-tracking code generator 18 in an embodiment receives image control signals and outputs modified image control signals after applying the respective white-tracking code to the received image control signals. Subsequently, the weighted white-tracking code generator 20 further modifies the modified image control signals outputted by the white-tracking code generator 18 with the respective first weights. As a result, the modified image control signals outputted by the weighted white-tracking code generator 20 are the original image control signals as being modified by both the white-tracking code and the first weights. In other words, the modified image control signals outputted by the weighted white-tracking code generator 20 are the original image control signals as being modified by weighted white-tracking codes WT1~WTn which reflect combinations of the white-tracking code and the first weights, respectively. The remaining elements, i.e., the multiplexers 22, 28, 32, the over-driving value generator 24 and the weighted over-driving value generator 26 can function in similar manners.

To sum up, a method of driving a liquid crystal display/panel in accordance with the disclosed embodiments of the present invention comprises the steps of: receiving a plurality of image control signals; changing the image control signals to obtain modified image control signals in accordance with different characteristics of the data lines; and using the modified image control signals to drive the liquid crystal display. More specifically, a method of driving a liquid crystal display/panel in accordance with the disclosed embodiments of the present invention comprises the steps of: receiving a plurality of image control signals; obtaining white-tracking image control signals based on the image control signals; changing the white-tracking image control signals to weighted white tracking image control signals in accordance with different characteristics of the data lines; obtaining over-driving image control signals in accordance with different characteristics of the data lines and the weighted white-tracking image control signals; and using the over-driving image control signals to drive the liquid crystal display.

In the disclosed embodiments, different weighted white-tracking codes and different weighted over-driving values are generated based on and supplied to different data lines. Further, source driver units with the same resistance or different resistances can be used to modify the image control signal provided to each pixel, thereby improving luminance uniformity of the liquid crystal display.

In addition, the contribution of gate high-voltage to the charging speed of the drain current of TFT would not be sacrificed, the gate high-voltage can be raised to achieve fast charging, and the transmittance performance of the liquid crystal display would not be affected due to insufficient charging.

Although several embodiments of the present invention have been described with reference to the drawings, it should be understood that the invention is not limited to the details thereof. Various substitutions and/or modifications have been suggested in the foregoing description, and other substitutions and/or modifications will occur to those of ordinary skill in the art upon considering the present disclosure. Therefore, all such substitutions and/or modifications are intended to be embraced within the scope of the invention as defined in the appended claims.

What is claimed is:

1. A method of driving a liquid crystal panel in response to a plurality of image control signals being transmitted to a plurality of pixels in said liquid crystal panel via a plurality of source driver units and a plurality of data lines respectively connected with the source driver units, said method comprising the steps of:

providing a white-tracking code;

applying a plurality of different first weights to said white-tracking code to obtain a plurality of weighted white-tracking codes, each of said first weights being associated with one of the data lines;

providing an over-driving value;

applying a plurality of different second weights to said over-driving value to obtain a plurality of weighted over-driving values, each of said second weights being associated with one of the data lines;

for each of said data lines, selecting and outputting one of said weighted white-tracking codes and one of said weighted over-driving values to the corresponding source driver unit to adjust said image control signals inputted to the pixels associated with said data line;

multiplexing the weighted white-tracking codes;

multiplexing the weighted over-driving values; and sending the multiplexed weighted white-tracking codes and the multiplexed weighted over-driving values to said source driver units so as to adjust said image control signals inputted to said pixels.

2. The method as claimed in claim 1, wherein at least one of the applying steps comprises multiplying said white-tracking code or the over-driving value by the first weights or the second weights, respectively.

3. The method as claimed in claim 1, wherein said first weights and/or said second weights are between 0 and 1.

4. The method as claimed in claim 1, wherein said first weights and/or said second weights are independent from said source driver units which have the same resistance.

5. The method as claimed in claim 1, wherein said first weights and/or said second weights are dependent on said source driver units which have different resistances.

6. The method as claimed in claim 1, further comprising:

multiplexing the weighted white-tracking codes and the weighted over-driving values together; and sending the multiplexed weighted white-tracking codes and weighted over-driving values to said source driver units so as to adjust said image control signals inputted to said pixels.

7. A liquid crystal display, comprising:

a liquid crystal panel having a plurality of data lines and a plurality of corresponding pixels;

a plurality of source driver units coupled to said data lines, respectively; and an image processor coupled to said source driver units for: receiving a plurality of image control signals, modifying the image control signals to obtain a plurality of modified image control signals in accordance with different characteristics of said data lines, and outputting said modified image control signals to said source driver units, respectively;

wherein said image processor comprises:

a white-tracking code generator for providing a white-tracking code;

a weighted white-tracking code generator coupled to said white-tracking code generator for generating a plurality of different weighted white-tracking codes each of which is based on the characteristic of one of the data lines;

a first multiplexer coupled to said weighted white-tracking code generator for receiving and selectively outputting said different weighted white-tracking codes;

an over-driving value generator coupled to said first multiplexer and for providing an over-driving value;

a weighted over-driving value generator coupled to said over-driving value generator for generating a plurality of different weighted over-driving values each of which is based on the characteristic of one of the data lines;

a second multiplexer coupled to said weighted over-driving value generator for receiving and selectively outputting said different weighted over-driving values;

and a line selector coupled to said first multiplexer and said second multiplexer for selecting one of said weighted white-tracking codes and one of said weighted over-driving values to modify the image control signal of each of said data lines.

8. The liquid crystal display as claimed in claim 7, wherein said source driver units have the same resistances.

9. The liquid crystal display as claimed in claim 7, wherein said source driver units have different resistances and the image processor is configured to modify the image control signals in accordance with said different resistances of the source driver units.

10. The liquid crystal display as claimed in claim 7, wherein at least one said weighted white-tracking code generator and said weighted over-driving value generator is configured to generate the respective weighted white-tracking codes and weighted over-driving values by applying a plurality of different first and second weights to said white-tracking code and said over-driving value, respectively.

11. The liquid crystal display as claimed in claim 10, wherein said first weights and/or said second weights are between 0 and 1.

12. A liquid crystal display, comprising:

a liquid crystal panel having a plurality of data lines and a plurality of corresponding pixels;

a plurality of source driver units coupled to said data lines, respectively; and an image processor coupled to said source driver units for:

receiving a plurality of image control signals, modifying the image control signals to obtain a plurality of modified image control signals in accordance with different characteristics of said data lines, and outputting said modified image control signals to said source driver units, respectively;

wherein said image processor comprises:

a white-tracking code generator for providing a white-tracking code;

a weighted white-tracking code generator coupled to said white-tracking code generator for generating a plurality of different weighted white-tracking codes each of which is based on the characteristic of one of the data lines;

an over-driving value generator for providing an over-driving value; a weighted over-driving value generator coupled to said weighted white-tracking code generator and said over-driving value generator and for generating a plurality of different weighted over-driving values each of which is based on the characteristic of one of the data lines and corresponds to one of said weighted white-tracking codes;

a multiplexer coupled to said weighted over-driving value generator for receiving and selectively outputting said weighted white-tracking codes and said corresponding weighted over-driving values; and a line selector coupled to said multiplexer for selecting one of said weighted white-tracking codes and one of said corresponding weighted over-driving values to modify the image control signal of each of said data lines.

13. The liquid crystal display as claimed in claim 12, wherein at least one said weighted white-tracking code generator and said weighted over-driving value generator is configured to generate the respective weighted white-tracking codes and weighted over-driving values by applying a plurality of different first and second weights to said white-tracking code and said over-driving value, respectively.

14. The liquid crystal display as claimed in claim 13, wherein said first weights and/or said second weights are between 0 and 1.

15. A method of driving a liquid crystal display, said liquid crystal display comprising a plurality of source driver units and a plurality of data lines connected therewith, said method comprising the steps of:

receiving a plurality of image control signals each intended for one of the data lines;

modifying said image control signals to obtain a plurality of modified image control signals in accordance with different characteristics of said data lines; and outputting said modified image control signals to the respective data lines to drive said liquid crystal display, wherein said modifying comprises:

providing a white-tracking code;

generating a plurality of different weighted white-tracking codes each of which is based on the characteristic of one of the data lines;

receiving and selectively outputting said weighted white-tracking codes;

providing an over-driving value;

generating a plurality of different weighted over-driving values each of which is based on the characteristic of one of the data lines;

receiving and selectively outputting said weighted over-driving values; and selecting one of said weighted white-tracking codes and one of said weighted over-driving values to modify the image control signal of each of said data lines.

16. The method as claimed in claim 15, wherein said modifying further comprises:

obtaining white-tracking image control signals based on said image control signals;

changing said white-tracking image control signals to weighted white tracking image control signals in accordance with the different characteristics of said data lines; and generating said modified image control signals based at least partially on said weighted white tracking image control signals.

17. The method as claimed in claim 16, wherein said modifying further comprises:

obtaining over-driving image control signals based on either based on said image control signals or said weighted white-tracking image control signals;

changing said over-driving image control signals to weighted over-driving image control signals in accordance with the different characteristics of said data lines; and generating said modified image control signals based on both said weighted white tracking image control signals and said weighted over-driving image control signals.

18. The method as claimed in claim 15, wherein said characteristics comprise at least one of i) positions of the respective data lines with respect to a center of the liquid crystal display; and ii) response speeds of pixels driven by the respective data lines.

* * * * *